US005336003A

United States Patent [19]

Nagashima et al.

[11] Patent Number: 5,336,003

[45] Date of Patent: Aug. 9, 1994

[54] LABEL PRINTER

[75] Inventors: Kiyomichi Nagashima, Yanagi; Hiroshi Uchida, Fujishiro, both of Japan

[73] Assignee: Tokyo Electric Co., Ltd., Tokyo, Japan

[21] Appl. No.: 19,840

[22] Filed: Feb. 19, 1993

[30] Foreign Application Priority Data

Feb. 20, 1992 [JP] Japan ..... 4-7207
Apr. 24, 1992 [JP] Japan ..... 4-106676

[51] Int. Cl.[5] ..... B41J 29/18

[52] U.S. Cl. ..... 400/708; 156/361; 156/384; 250/227.28; 250/548; 250/571

[58] Field of Search ..... 400/120, 703; 177/25.15; 156/361, 384; 250/548, 571, 227.28

[56] References Cited

U.S. PATENT DOCUMENTS 4,639,287 1/1987 Sakura ..... 156/361
4,872,119 10/1989 Kajimoto ..... 177/25.15
5,049,228 9/1991 Sato ..... 156/348

FOREIGN PATENT DOCUMENTS 4-11659 1/1992 Japan .

*Primary Examiner*—Eugene H. Eickholt
*Attorney, Agent, or Firm*—Oblon, Spivak, McClelland, Maier & Neustadt

[57] ABSTRACT

A label printer including a printing section for printing a given image on a label, a label issue opening for issuing the label after the given image is printed thereon by the printing section, a sensor having a light emitting element and a light receiving element, a first prism having a reflecting surface located on one side of the label issue opening, and a second prism having a reflecting surface located on the other side of the label issue opening. The light emitted from the light emitting element is reflected on the reflecting surface of the first prism, and is then reflected on the reflecting surface of the second prism to reach the light receiving element. When the label is issued from the label issue opening, an optical axis between the reflecting surfaces of the first and second prisms intersects a surface of the label. Thus, the presence of the label projecting from the label issue opening can be surely detected.

8 Claims, 9 Drawing Sheets

LABEL PRINTER

BACKGROUND OF THE INVENTION

1. Field of the Invention

The present invention relates to a label printer for printing a given image on a label and issuing the label.

2. Description of Related Art

A label printer of this kind has already been proposed by the present assignee in Japanese Utility Model Application Nos. 3-98205 and 3-98975, for example. Such a label printer will be described with reference to FIGS. 11 to 13. Referring to FIGS. 11 and 12, reference numeral 101 generally designates a label printer having a body housing 102. A printing section 103 and a storing section 104 are provided in the body housing 102 at front and rear portions thereof, respectively. The storing section 104 is adapted to rotatably support a roll of a label sheet 105 (see FIG. 11) or a label sheet 106 (see FIG. 12). The label sheet 105 consists of a continuous base sheet (not shown) and a plurality of labels (not shown) releasably attached to an inside surface of the rolled base sheet, while the label sheet 106 consists of a continuous base sheet (not shown) and a plurality of labels (not shown) releasably attached to an outside surface of the rolled base sheet. The printing section 103 is adapted to print a given image on the labels of the label sheet 105 or 106. The printing section 103 includes a line head 108 pivotably supported at a rear end portion thereof by a support shaft 107, a platen roller 109 located under the line head 108 at a front end portion thereof, and a position holding mechanism (not shown) such as a locking mechanism for releasably pressing the line head 108 against the platen roller 109 and holding such an operative position of the line head 108. As shown in FIG. 13, the body housing 102 is constituted by a lower housing 110 and an upper housing 111 mounted on the lower housing 110 so as to be pivotably supported at a rear end portion thereof. The printing section 103 and the storing section 104 are normally covered with the upper housing 111. A pair of guide plates 113 and 114 are located under the rear end portion of the line head 108. A light emitting element and a light receiving element (neither shown) are mounted in the guide plates 113 and 114, respectively, to constitute a position sensor (not shown) for detecting a position of each label of the label sheet 105 or 106. A label separator 115 for sharply bending the base sheet of the label sheet 105 or 106 to thereby separate each label from the base sheet after printing is located before the platen roller 109. An ejection roller 116 for ejecting the base sheet of the label sheet 105 or 106 after separating each label is located below the platen roller 109 in contact therewith so as to be driven by the platen roller 109.

Although not shown, a sensor is provided before the label separator 115 to detect the presence of the label projecting forward from the label separator 115 after separation of the label from the base sheet. Further, a contact switch (not shown) as a movable member detecting device is located at a position interfering with a part of the line head 108 during pivotal movement of the line head 108 about the support shaft 107, so as to detect the pivotal movement of the line head 108.

In operation, the roll of the label sheet 105 or 106 selectively stored in the storing section 104 is unwound to be fed through the guide plates 113 and 114 to the printing section 103. In the printing section 103, the label of the label sheet 105 or 106 is thermally scanned by the line head 108 as being fed by the platen roller 109 to print a given image on the label. At this time, the position of each label of the label sheet 105 or 106 fed by the platen roller 109 is detected by the position sensor provided in the guide plates 113 and 114 to control operation timing of the line head 108.

After printing the given image on the label attached to the base sheet of the label sheet 105 or 106, the base sheet only is sharply bent by the label separator 115 to separate the label from the base sheet. Then, the base sheet is fed so as to be ejected by the eject roller 116 and the platen roller 109. On the other hand, the label separated from the base sheet is issued so as to project forward from the label separator 115. Alternatively, after printing a given image on the label of the label sheet 105 or 106, the label sheet 105 or 106 may be issued without bending the base sheet and separating the label from the base sheet by means of the label separator 115. At this time, the presence of the label or the label sheet 105 or 106 projecting forward from the label separator 115 after separation is detected by the sensor located before the label separator 115 to thereby control a drive timing of the platen roller 109.

In the case of replacing the label sheet 105 or 106 or removing jamming which has occurred in the label printer 101, the upper housing 111 and the line head 108 are swung upwardly to expose the storing section 104 and the printing section 103 to the outside of the label printer 101. In manually setting the label sheet 105 or 106 into the printing section 103, the label sheet 105 or 106 is first inserted between the guide plates 113 and 114 and then put on the platen roller 109. Then, the base sheet of the label sheet 105 or 106 is inserted between the platen roller 109 and the ejection roller 116. In the condition where the line head 108 is upwardly swung, it is necessary to stop the operation of the printing section 103. In this line printer 101, the upwardly swung condition of the line head 108 is detected by the contact switch to thereby control power supply to the printing section 103.

The sensor for detecting the presence of the label projecting forward from the label separator 115 is constructed of optical means in general. Examples of such an optical sensor in the related art will be described with reference to FIGS. 14 to 17.

FIGS. 14 and 15 show a first example of the optical sensor in the related art. Referring to FIG. 14, reference numeral 4 generally designates a printer having a body housing 1 in which a line head 2 and an eject unit 3 are provided in spaced relationship from each other. Thus, a label issue opening 5 having a predetermined width is defined between the line head 2 and the eject unit 3 at their front ends. A light emitting element 6 is located below the label issue opening 5 on the side near one end of the opening 5, and a light receiving element 7 is located above the label issue opening 5 on the side near the other end of the opening 5 so as to receive light emitted from the light emitting element 6. Accordingly, an optical axis 9 obliquely intersecting a label 8 issued from the label issue opening 5 is formed between the light emitting element 6 and the light receiving element 7.

FIGS. 16 and 17 show a second example of the optical sensor in the related art. In FIGS. 16 and 17, the same reference numerals as those appearing in FIGS. 14 and 15 designate the same parts, and an explanation thereof will be omitted. In this example, a reflective sensor 12 constructed of a light emitting element 10 and a light receiving element 11 in an integral structure is provided over the label issue opening 5 at a central position thereof.

The problems in the above related art will now be described. First, in the label printer 101, the swung condition of the line head 108 is detected by the contact switch, and the power supply to the printing section 103 is controlled according to the detection result from the contact switch. However, the contact switch as the movable member detecting device can merely detect the movement of only one movable member. Accordingly, when there are many movable members whose movements are required to be detected, many movable member detecting devices corresponding to the movable members must accordingly be installed, thus hindering a reduction in size and weight of an equipment and the productivity thereof.

In the first example of the optical sensor shown in FIGS. 14 and 15, detection is possible in the case where the width of the label 8 is large as shown by letter A in FIG. 15. However, the detection is impossible in the case where the width of the label 8 is small as shown by letter B in FIG. 15. Such a defect may be eliminated by offsetting the position of the optical axis 9 intersecting the label 8 toward one end of the label issue opening 5 in the case where an issue reference of the label 8 is set at the one end of the label issue opening 5. However, in the first example, the distance between the light emitting element 6 and the light receiving element 7 is large, so that scattering of the light is apt to occur, thus reducing a reliability of detection.

Further, in the second example of the optical sensor shown in FIGS. 16 and 17, the reflective sensor 12 itself has a diameter of 5.8 mm, and the amount of projection from a mounting surface of the reflective sensor 12 inclusive of its mounting member becomes about 10 mm. Accordingly, in the case that the label 8 is issued from the label issue opening 5 without being separated from the base sheet and that the label 8 issued is cut together with the base sheet by means of a cutter (not shown) located on the downstream side of the reflective sensor 12 in respect of an issuing direction of the label 8, there is a possibility that the reflective sensor 12 will interfere with the label 8 so as to damage the label 8. Further, since the reflective sensor 12 is located at the central position of the label issue opening 5, there arises a problem in manufacture such that electrical wiring to the reflective sensor 12 is difficult so to make the assembly operation hard to accomplish. In addition, since the wiring to the reflective sensor 12 appears outside of the label printer, the appearance of the printer will be spoiled.

SUMMARY OF THE INVENTION

It is an object of the present invention to provide a label printer which can surely detect a label issued from a label issue opening, eliminate the possibility of damage of the label in cutting the same, and easily mount a sensor for detecting the label.

It is another object of the present invention to provide a label printer which can detect the movement of a plurality of movable members with a single sensor.

The label printer of the present invention is provided with a label issue opening for issuing a label on which a given image has been printed by a printing section, a sensor constituted by a light emitting element and a light receiving element, a first prism located on one side of the label issue opening, and a second prism located on the other side of the label issue opening. The first prism has a reflecting surface for reflecting light emitted from the light emitting element, and the second prism has a reflecting surface for reflecting the light reflected on the reflecting surface of the first prism. The light reflected on the reflecting surface of the second prism is received by the light receiving element. Thus, an optical path is formed so as to lead from the light emitting element through the reflecting surfaces of the first and second prisms to the light receiving element. When the label is issued from the label issue opening, a part of the optical path between the reflecting surfaces of the first and second prisms intersects the label issued, so that the presence of the label projecting from the label issue opening is detected by the sensor. As a part of the optical path from the light emitting element to the light receiving element is formed in the first and second prisms, scattering of the light can be reduced, and the detection can be surely effected regardless of the position along the label issue opening where the optical path intersects the label. Further, as the thickness of each prism can be made small, the amount of projection of each prism from the label issue opening can be reduced. Accordingly, in the case of cutting the label together with the base sheet issued from the label issue opening, there is no possibility that each prism will interfere with the label so as to damage the label. Further, as the light emitting element and the light receiving element to be electrically wired are located aside one end of the label issue opening in a longitudinal direction thereof, the electrical wiring to each element can be easily carried out, and it does not appear outside of the label printer, thus improving the appearance.

In another aspect of the present invention, the label printer is provided with a label issue opening for issuing a label on which a given image has been printed by a printing section, a plurality of position holding mechanisms for respectively positioning a plurality of movable members, a sensor constituted by a light emitting element and a light receiving element, and a plurality of reflecting surfaces provided on the movable members for forming an optical path leading from the light emitting element to the light receiving element in the condition where the movable members are positioned by the position holding mechanisms. When at least one of the movable members is moved, the optical path is cut off to thereby detect the movement of the at least one movable member moved. Thus, the movement of a plurality of movable members can be detected by a single sensor to contribute to a reduction in size and weight of equipment employing a plurality of movable members and an improvement in productivity of the equipment.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

DESCRIPTION OF THE PREFERRED EMBODIMENTS

Figure 1:
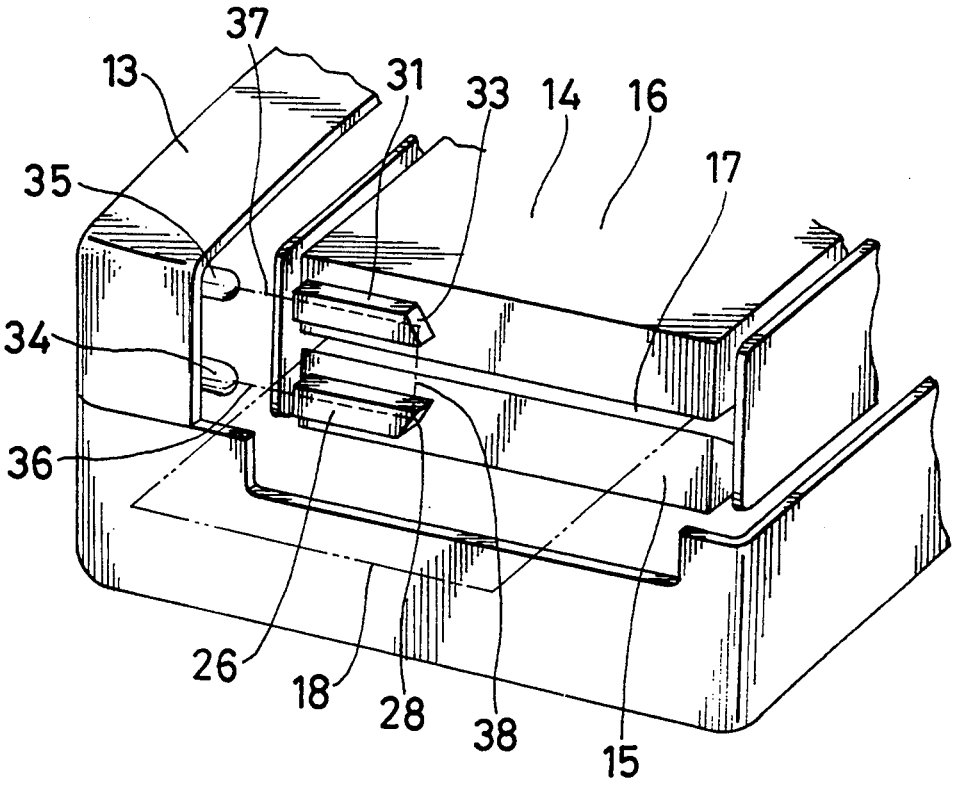
FIG. 1 is a perspective view of a label issuing portion of a label printer in a first preferred embodiment according to the present invention.
Figure 2:
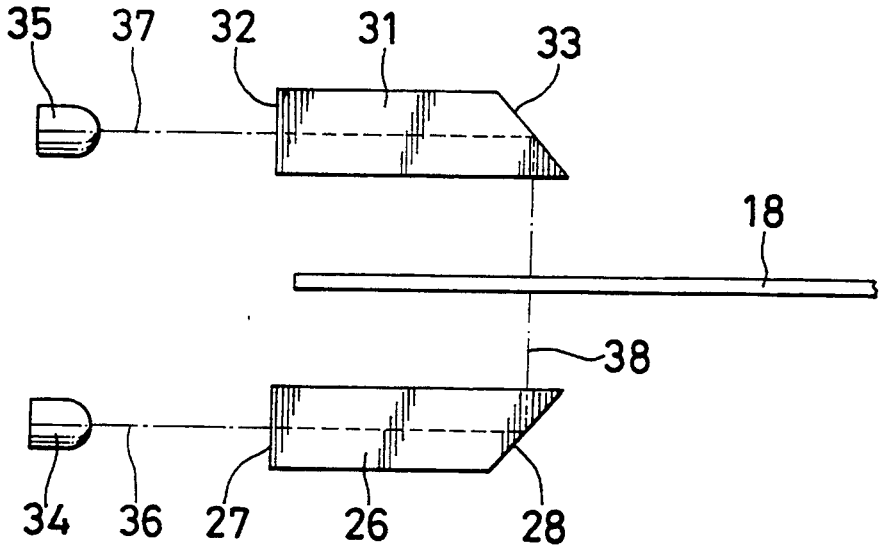
FIG. 2 is a front elevation illustrating the positional relationship between an optical axis for label detection and a label in the label printer shown in FIG. 1.

A first preferred embodiment of the present invention will be described with reference to FIGS. 1 to 4. Reference numeral 16 generally designates a printer having a body housing 13 in which a printing section 14 and an ejection unit 15 are provided in spaced relationship from each other. Thus, a label issue opening 17 having a predetermined width is defined between the printing section 14 and the ejection unit 15 at their front ends. A label separator 20 having an acute angle portion is provided between the printing section 14 and the ejection unit 15 to sharply bend an elongated base sheet 19 on which a label 18 is releasably attached and separate the label 18 from the base sheet 19.

A storing section 21 for storing a roll of the base sheet 19 with the label 18 is provided in the body housing 13. The roll of the base sheet 19 with the label 18 is unwounded to be fed by a platen 22, and a given image is printed on the label 18 attached to the base sheet 19 at the position of the platen 22 by means of the printing section 14. An ejection roller 23 is provided in the ejection unit 15 below the platen 22 to press the base sheet 19 against the platen 22 and eject the base sheet 19 in cooperation with the platen 22. The label 18 separated from the base sheet 19 by the label separator 20 is issued from the label issue opening 17 with an issue reference of the label 18 being set at one end of the label issue opening 17.

Figure 3:
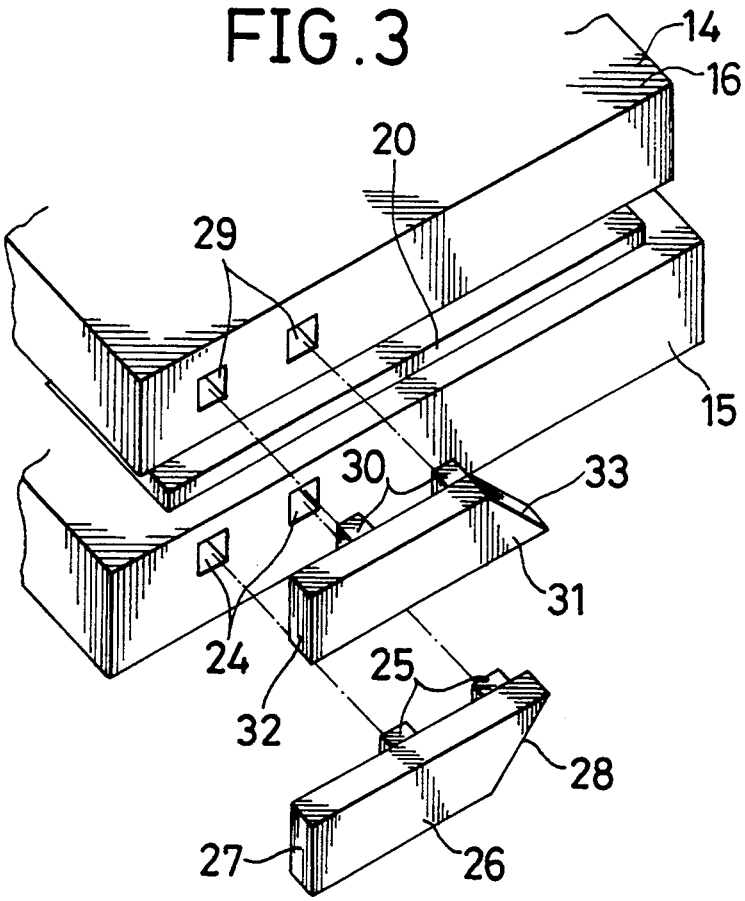
FIG. 3 is an exploded perspective view illustrating the mounting structure of prisms in the label printer shown in FIG. 1.
Figure 4:
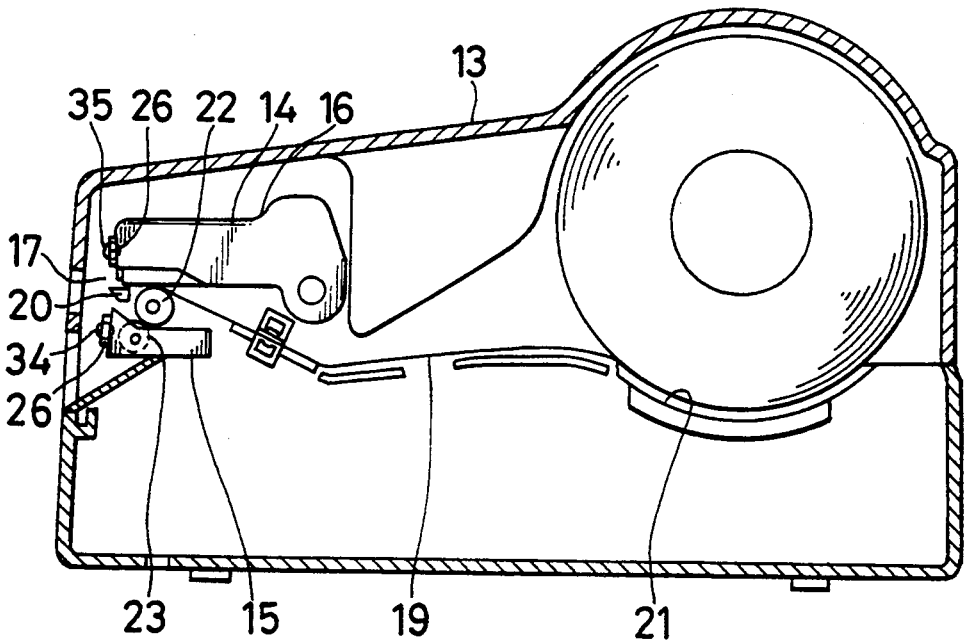
FIG. 4 is a vertical sectional view in side elevation of the label printer in the first preferred embodiment.

As shown in FIG. 3, two positioning recesses 24 are formed on a front end surface of the ejection unit 15 in horizontally spaced relationship from each other, and a first prism 26 having two projections 25 respectively engaging with the two positioning recesses 24 is fixed to the front end surface of the ejection unit 15 so as to extend along the label issue opening 17. The first prism 26 has one end surface 27 as a vertical surface and another end surface 28 as a reflecting surface inclined at 45 degrees. Similarly, two positioning recesses 29 are formed on a front end surface of the printing section 14 in horizontally spaced relationship from each other, and a second prism 31 having two projections 30 respectively engaging with the two positioning recesses 29 is fixed to the front end surface of the printing section 14 so as to extend along the label issue opening 17. The second prism 31 has one end surface 32 as a vertical surface and another end surface 33 as a reflecting surface inclined at 45 degrees. Each of the first and second prisms 26 and 31 has a thickness of about 3 mm. Thus, the first prism 26 is trapezoidal as viewed in front elevation so as to be elongated from the vertical surface 27 to the reflecting surface 28, and the second prism 31 is similarly trapezoidal as viewed in front elevation so as to be elongated from the vertical surface 32 to the reflecting surface 33.

A sensor 200 constituted by a light emitting element 34 and a light receiving element 35 is provided on the side near one end of the label issue opening 17 in the longitudinal direction thereof, that is, located aside one end of the label issue opening 17 in the longitudinal direction thereof. The light emitting element 34 is positioned so as to have an optical axis 36 in the longitudinal direction of the first prism 26, and the light receiving element 35 is positioned so as to have an optical axis 37 in the longitudinal direction of the second prism 31. Both the light emitting element 34 and the light receiving element 35 are mounted on the same mounting member (not shown) and arranged in the proximity to each other. The sensor 200 is located on the same side as the side of the issue reference of the label 18, which is set at one end of the label issue opening 17.

The reflecting surfaces 28 and 33 of the first and second prisms 26 and 31 are arranged so as to form an optical axis 38 therebetween in a direction perpendicular to the issuing direction of the label 18. That is, the optical axis 38 perpendicularly intersects the surface of the label 18.

In operation, the base sheet 19 with the label 18 is drawn from the storing section 21 to pass between the platen 22 and the printing section 14. At this time, a given image is printed on the label 18 by the printing section 14. Then, the base sheet 19 only is sharply bent by the label separator 20, so that the label 18 is separated from the base sheet 19. Then, the label 18 on which the given image has been printed is substantially horizontally issued from the label issue opening 17. On the other hand, the base sheet 19 itself nipped by the platen 22 and the eject roller 23 is fed downwardly thereby to be ejected outside of the label printer 16.

The issue of the label 18 is carried out only when no label is present at the label issue opening 17. That is, when the label 18 is issued, the label 18 intersects with the optical axis 38 between the reflecting surfaces 28 and 33 of the first and second prisms 26 and 31. Therefore, the light from the light emitting element 34 through the first and second prisms 26 and 31 to the light receiving element 35 is cut off by the label 18 projecting from the label issue opening 17. As a result, a signal indicating that the label 18 is present at the label issue opening 17 is generated from the sensor 200. In this condition, even when the issue of the subsequent label is instructed, the next label issue operation is inhibited.

According to the first preferred embodiment, the light emitting element 34 and the light receiving element 35 are located in the proximity with each other, and the reflecting surfaces 28 and 33 of the first and second prisms 26 and 31 are inclined at 45 degrees to form the optical axis 38 perpendicular to the issue direction of the label 18. Therefore, the length of the optical axis 38 between the reflecting surfaces 28 and 33 can be reduced. Further, since the sensor 200 is located on the side of the issue reference of the label 18, the total length of the optical axes 36, 37 and 38 can be reduced. Further, the first and second prisms 26 and 31 are elongated in the directions of the optical axes 36 and 37, respectively. Therefore, the distance between the light emitting element 34 and the vertical surface 27 of the first prism 26 and the distance between the light receiving element 35 and the vertical surface 32 of the second prism 31 can be reduced. As a result, scattering of the light in the overall optical path from the light emitting element 34 to the light receiving element 35 can be suppressed to reduce loss of the light and effect efficient detection. Accordingly, it is unnecessary to increase a quantity of the light to be emitted from the light emitting element 34.

Further, the light emitting element 34 and the light receiving element 35 are located aside one end of the label issue opening 17 in the longitudinal direction thereof. Therefore, although the diameters of the light emitting element 34 and the light receiving element 35 are relatively large, a sufficient space for installation of the elements 34 and 35 can be ensured, and they can be easily mounted. Further, the thickness of each of the first and second prisms 26 and 31 is small, such as 3 mm. That is, an amount of projection of each prism from the label issue opening 17 is small. Therefore, even when the label 18 issued from the label issue opening 17 is cut together with the base sheet 19, there is no possibility that the prisms 26 and 31 will interfere with the label 18 to damage the label 18.

Further, since the reflecting surfaces 28 and 33 of the prisms 26 and 31 are inclined at 45 degrees, the location of the prisms 26 and 31 can be easily selected to make easy the designing and the manufacturing. Further, the first prism 26 is positioned by engaging the projections 25 with the positioning recesses 24 of the ejection unit 15, and the second prism 31 is similarly positioned by engaging the projections 30 with the positioning recesses 29 of the printing section 14. Therefore, positioning of the prisms 26 and 31 can be easily performed in mounting the prisms 26 and 31.

In the case where the width of the label 18 is not fixed and that the issue reference of the label 18 is set at a central position of the label issue opening 7, the location of the prisms 26 and 31 is set so that the optical axis 38 may intersect the label 18 even with the smallest width. In this case, the lengths of the prisms 26 and 31 are suitably selected as required.

Figure 5:
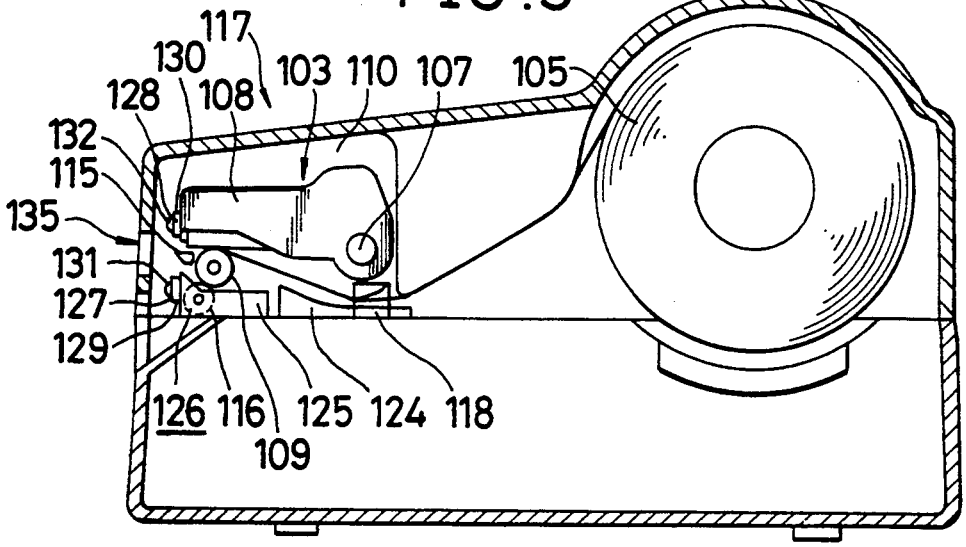
FIG. 5 is a vertical sectional view in side elevation of a label printer in a second preferred embodiment according to the present invention.
Figure 6:
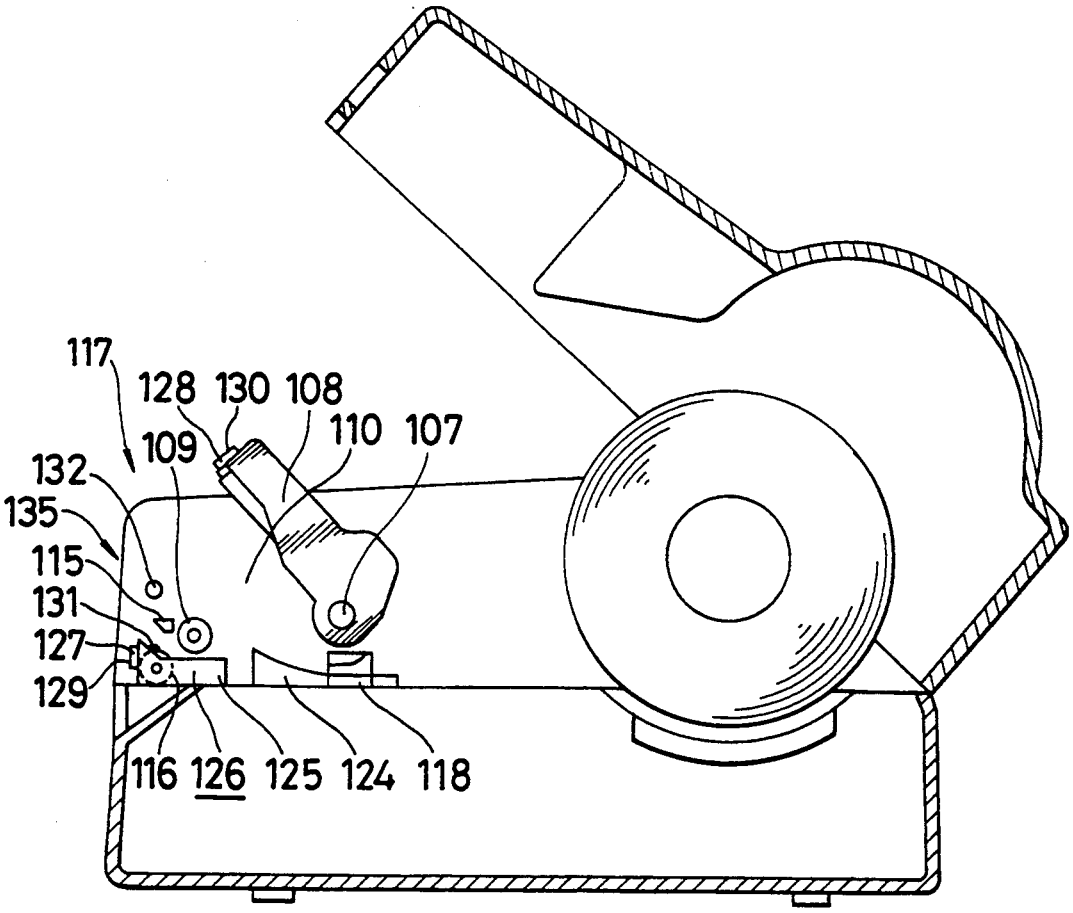
FIG. 6 is a view similar to FIG. 5, showing a condition where movable members have been moved.
Figure 7:
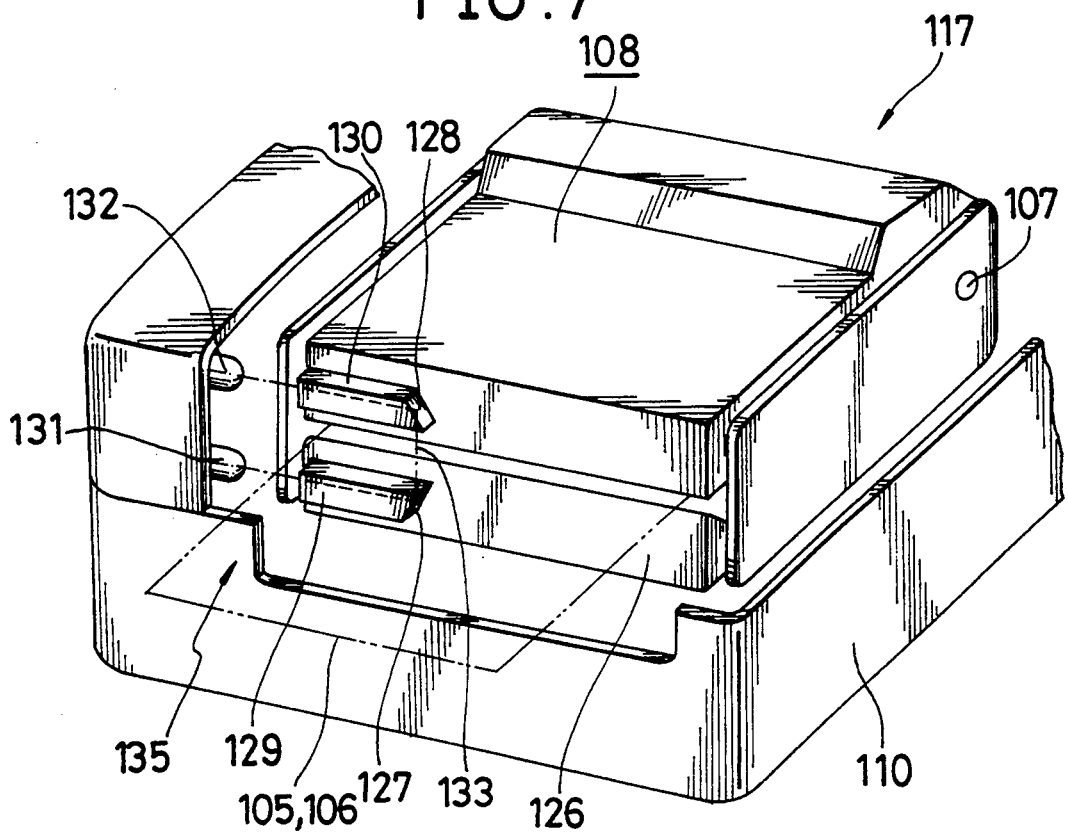
FIG. 7 is a perspective view of a label issuing portion of the label printer shown in FIG. 5.
Figure 9:
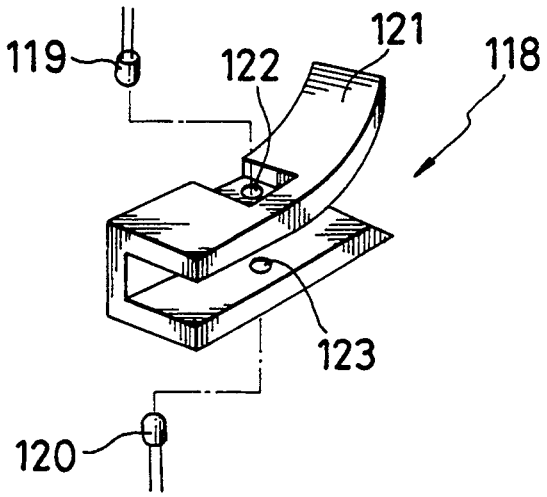
FIG. 9 is an exploded perspective view of a position sensor and a guide member for mounting the position sensor in the label printer shown in FIG. 5.
Figure 10:
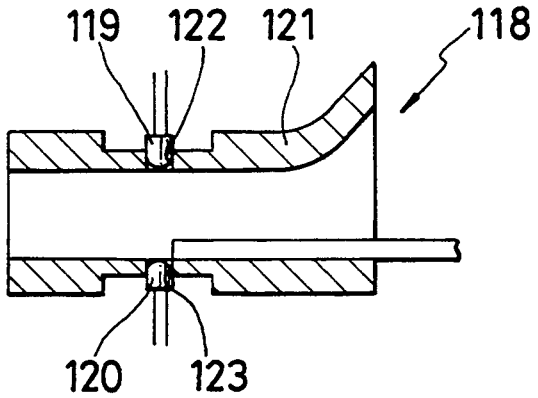
FIG. 10 is a vertical sectional view in side elevation of the position sensor and the guide member shown in FIG. 9.
Figure 11:
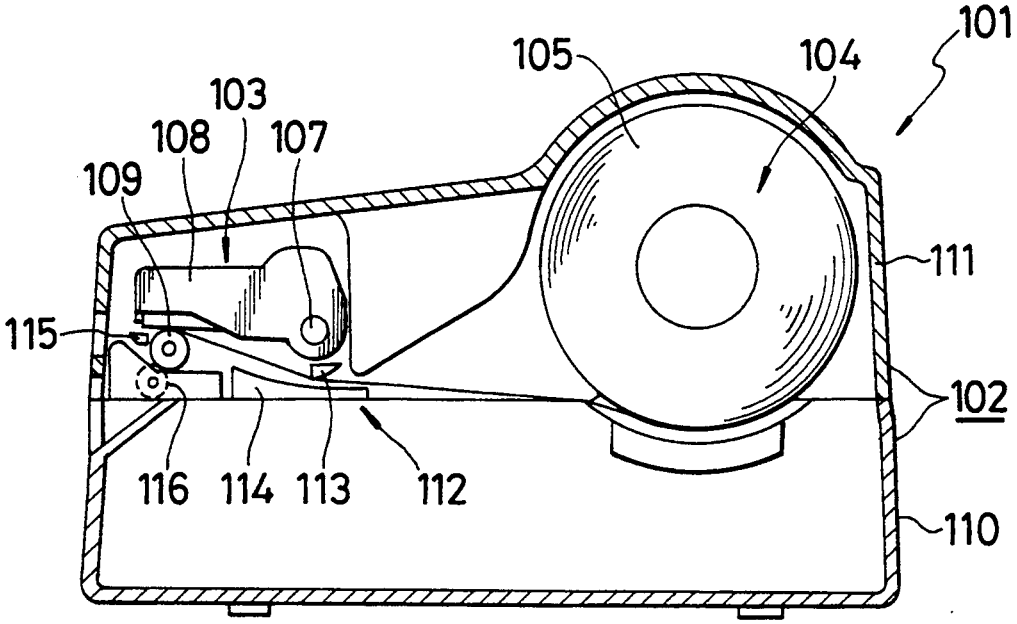
FIG. 11 is a vertical sectional view in side elevation of a label printer in the related art as proposed by the present assignee, showing the case where a label is attached to an inside surface of a rolled base sheet.
Figure 12:
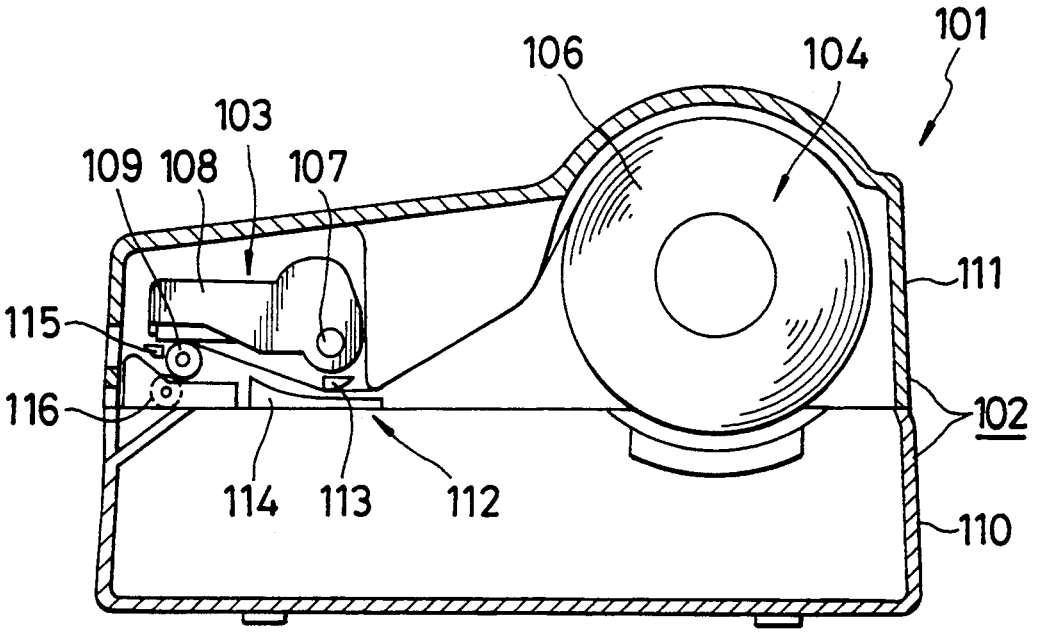
FIG. 12 is a view similar to FIG. 11, showing the case where a label is attached to an outside surface of a rolled base sheet.
Figure 13:
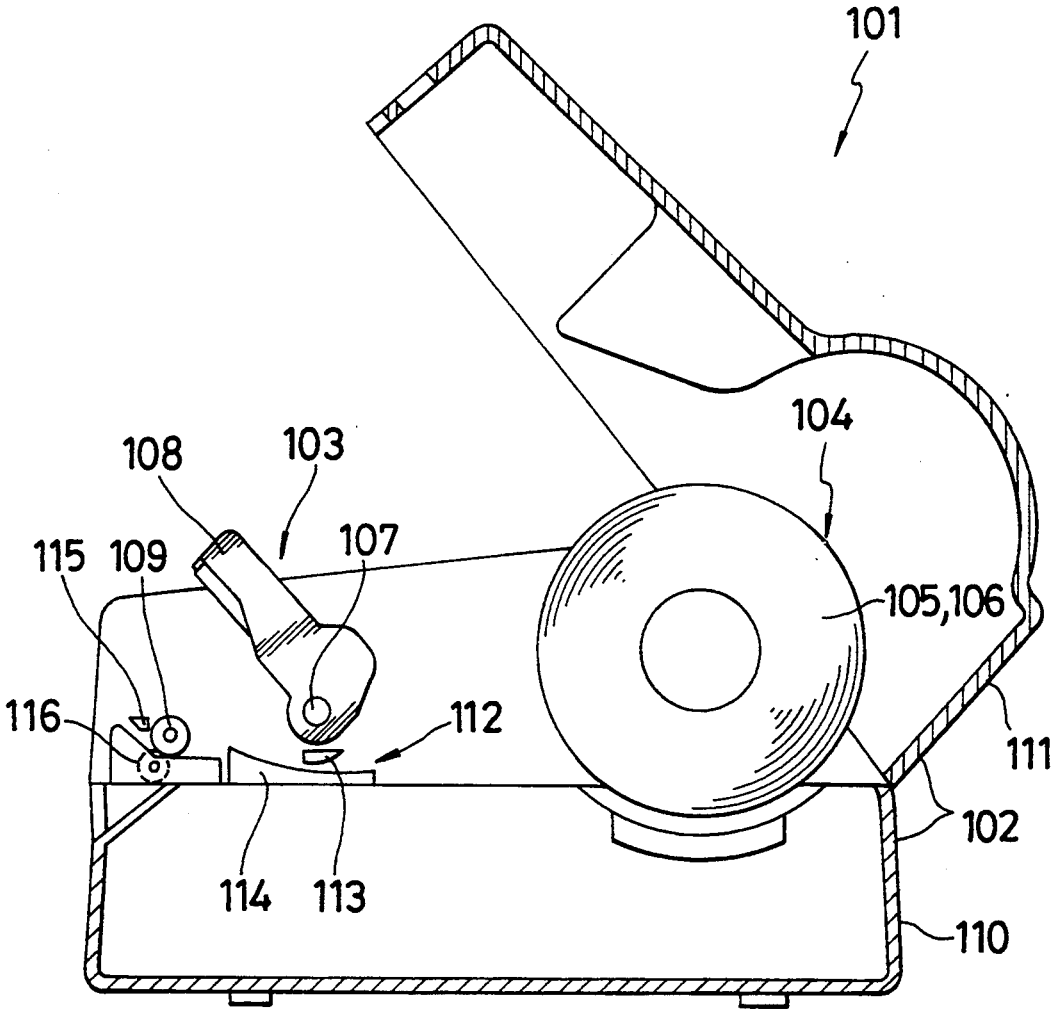
FIG. 13 is a view similar to FIG. 11, showing a condition where movable members have been moved.
Figure 14:
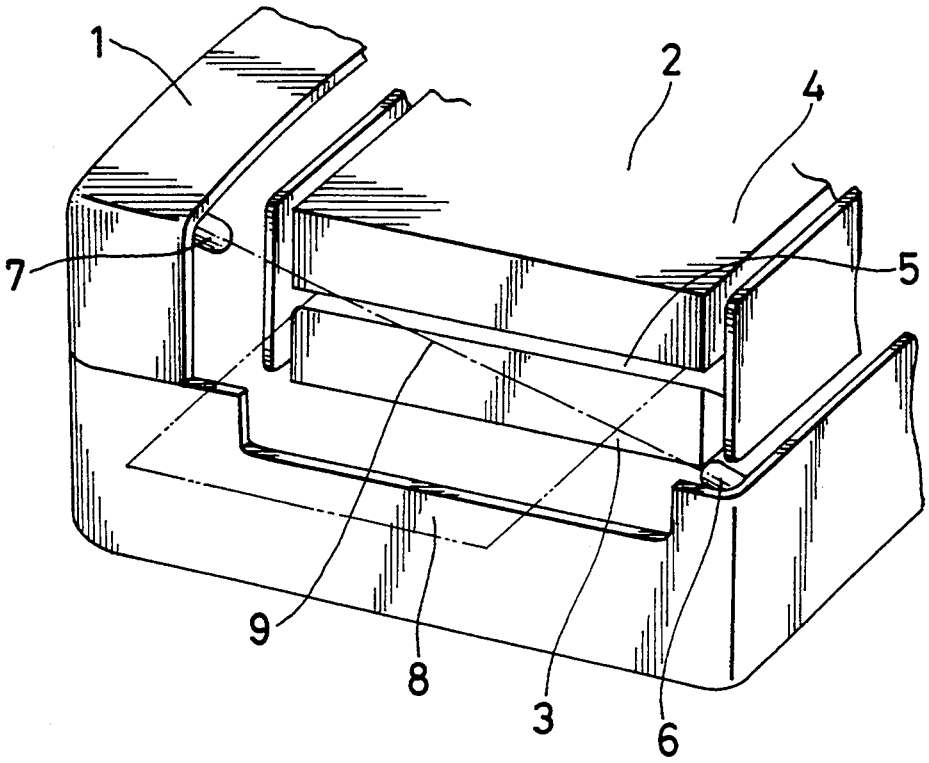
FIG. 14 is a perspective view illustrating a first example of a sensor for detecting the presence of a label issued from a label issue opening in the related art.
Figure 15:
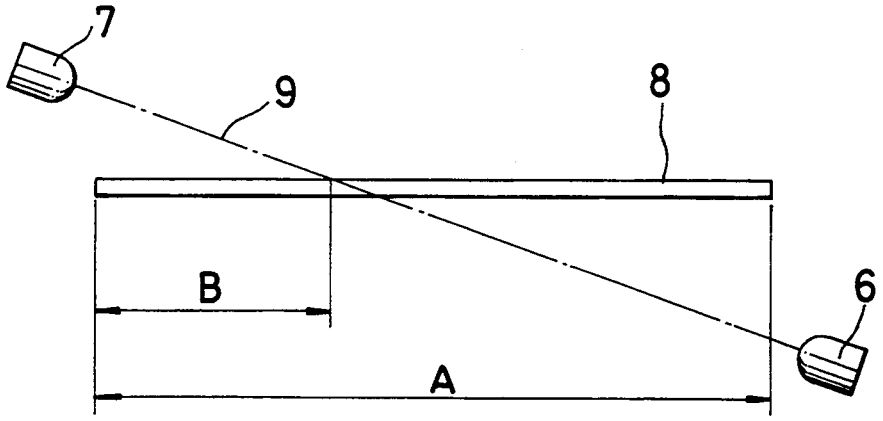
FIG. 15 is a front elevation illustrating a positional relation between an optical axis of the sensor and the label shown in FIG. 14.
Figure 16:
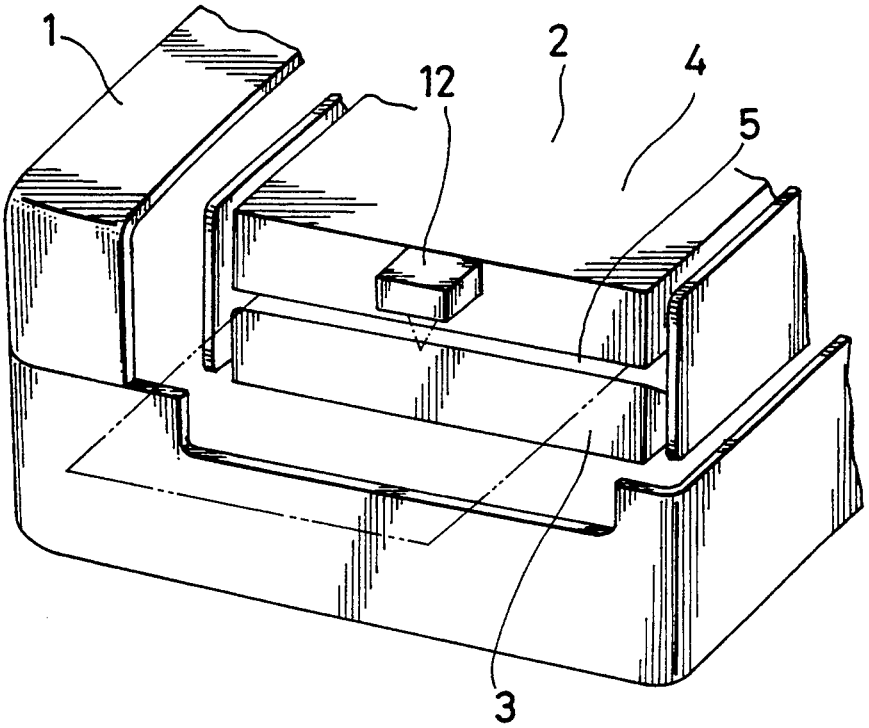
FIG. 16 is a view similar to FIG. 14, illustrating a second example of the sensor.
Figure 17:
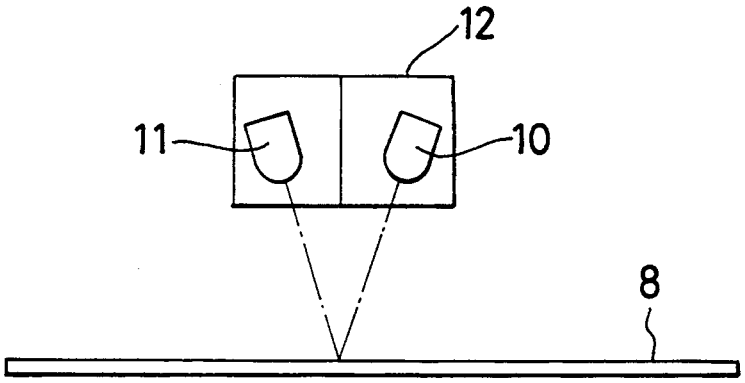
FIG. 17 is a view similar to FIG. 15, illustrating the second example of the sensor shown in FIG. 16.

A second preferred embodiment according to the present invention will be described with reference to FIGS. 5 to 10, in which the same parts as those shown in FIGS. 11 to 13 are designated by the same reference numerals, and the explanation thereof will be omitted hereinafter as required. Referring to FIGS. 5 to 7, reference numeral 117 generally designates a label printer having a body housing 102. A printing section 103 and a storing section 104 are provided in the body housing 102 at front and rear portions thereof, respectively. The storing section 104 is adapted to rotatably support a roll of a label sheet 105 or 106. The printing section 103 is adapted to print a given image on a label (not shown) attached to a base sheet (not shown) constituting the label sheet 105 or 106. The printing section 103 as one of the movable members includes a line head 108 pivotably supported at a rear end portion thereof by a support shaft 107, a platen roller 109 located under the line head 108 at a front end portion thereof, and a position holding mechanism (not shown) such as a locking mechanism for releasably pressing the line head 108 against the platen roller 109 and holding such an operative position of the line head 108. The body housing 102 is constituted by a lower housing 110 and an upper housing 111 mounted on the lower housing 110 so as to be pivotably supported at a rear end portion thereof. The printing section 103 and the storing section 104 are normally covered with the upper housing 111. A position sensor 118 for detecting the position of the label of the label sheet 105 or 106 is provided under the rear end portion of the line head 108. As shown in FIGS. 9 and 10, the position sensor 118 is constituted by a light receiving element 119 and a light emitting element 120. Reference numeral 121 designates a sectionally U-shaped guide member for guiding the label sheet 105 or 106. The guide member 121 has an upper plate portion formed with a through hole 122 and a lower plate portion formed with a through hole 123. The light receiving element 119 is engaged with the through hole 122 of the upper plate portion from the upper side thereof, and the light emitting element 120 is engaged with the through hole 123 of the lower plate portion from the lower side thereof. Referring back to FIGS. 5 and 6, a guide member 124 is formed integrally with the lower housing 110 at a position under the line head 108, and the guide member 121 provided with the light receiving element 119 and the light emitting element 120 is mounted on the guide member 124.

A label separator 115 for sharply bending the base sheet of the label sheet 105 or 106 to thereby separate the label from the base sheet after printing is located before the platen roller 109. An ejection roller 16 for ejecting the base sheet of the label sheet 105 or 106 after separating the label is located below the platen roller 109 in contact therewith so as to be driven by the platen roller 109. The ejection roller 116 is rotatably supported to a support frame 125. The support frame 125 is supported to the lower housing 110 by a position holding mechanism (not shown) such as guide rails so as to be slidable in the frontward and rearward directions. Thus, the ejection roller 116 and the support frame 125 constitute an ejection unit 126 as one of the movable members.

As shown in FIG. 7, a first prism 129 having a reflecting surface 127 is mounted on a front end surface of the ejection unit 126, and a second prism 130 having a reflecting surface 128 is similarly mounted on a front end surface of the line head 108. The reflecting surfaces 127 and 128 are inclined at 45 degrees so as to face each other. Although not shown, the prisms 129 and 130 are provided with projections, and the front end surfaces of the ejection unit 126 and the line head 108 are provided with recesses. The projections of the prisms 129 and 130 are engaged with the recesses of the ejection unit 126 and the line head 108, thus effecting positioning of the prisms 129 and 130. A label issue opening 300 is defined between the line head 108 and the ejection unit 126 at their front ends. The label of the label sheet 105 or 106 is adapted to be issued from the label issue opening 300 with an issue reference of the label being set at one end of the label issue opening 300 in a longitudinal direction thereof. Thus, the line head 108 and the ejection unit 126 constitute the first and second members for defining the label issue opening according to the present invention.

Figure 8:
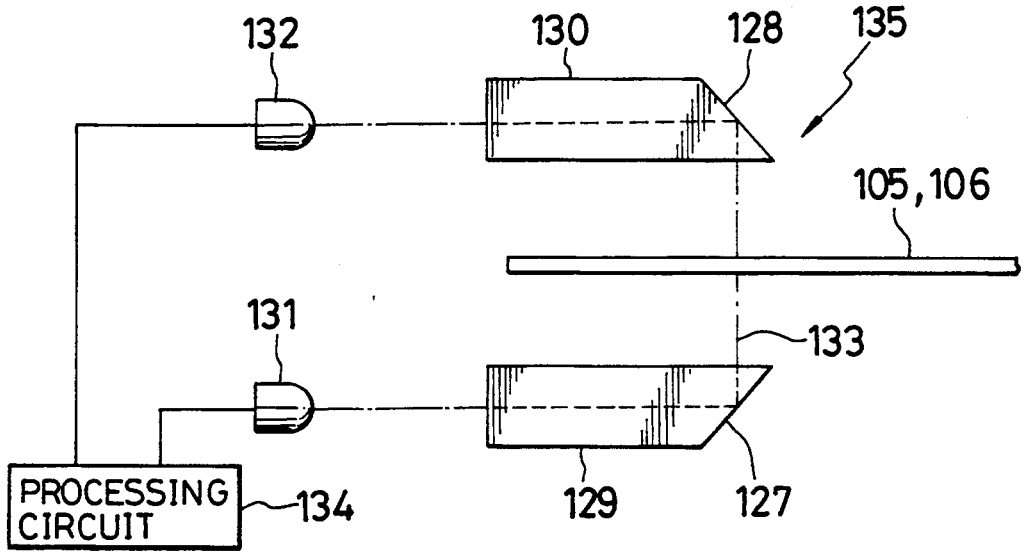
FIG. 8 is a front elevational view of a movable member detecting device in the label printer shown in FIG. 5.

As shown in FIGS. 7 and 8, the reflecting surface 127 inclined at 45 degrees is formed at one end of the first prism 129, and the reflecting surface 128 inclined at 45 degrees is formed at one end of the second prism 130. A light emitting element 131 is mounted on the lower housing 110 so as to be opposed through another end of the first prism 129 to the reflecting surface 127, and a light receiving element 132 is mounted on the lower housing 110 so as to be opposed through another end of the second prism 130 to the reflecting surface 128. The light emitting element 131 and the light receiving element 132 constitute a sensor 301. As shown in FIG. 8, an optical path 133 leading from the light emitting element 131 through the reflecting surfaces 127 and 128 of the prisms 129 and 130 to the light receiving element 132 is formed, and a processing circuit 134 such as CPU (central processing unit) is connected to the elements 131 and 132 to form a movable member detecting device 135.

When the line head 108 is swung upwardly or the ejection unit 126 is slid frontward as shown in FIG. 6, the optical path 133 is cut off, and in accordance therewith the movable member detecting device 135 detects the movement of the line head 108 or the ejection unit 126. Furthermore, when the label separated from the base sheet by the label separator 115 is issued from the label issue opening 300, the label intersects a vertical portion of the optical path 133 formed between the reflecting surfaces 127 and 128, so that the optical path 133 is cut off. Accordingly, the movable member detecting device 135 also detects the presence of the label projecting from the label issue opening 300.

In operation, the roll of the label sheet 105 or 106 selectively stored in the storing section 104 is unwound so as to be fed through the guide member 124 to the printing section 103. In the printing section 103, the label of the label sheet 105 or 106 is thermally scanned by the line head 108 as being fed by the platen roller 109 to print a given image on the label. At this time, the position of the label of the label sheet 105 or 106 fed by the platen roller 109 is detected by the position sensor 118 to control operational timing of the line head 108.

After printing the given image on the label attached to the base sheet of the label sheet 105 or 106, the base sheet only is sharply bent by the label separator 115 to separate the label from the base sheet. Then, the base sheet is fed so as to be ejected by the ejection roller 116 and the platen roller 109, thus issuing the label on which the given image has been printed. At the time of issuing, the label projects forward from the label separator 115 and intersects the optical path 133. As a result, the optical path 133 is cut off by the label to change a detection output of the light receiving element 133 from an on-state to an off-state. Then, this change is detected by the processing circuit 134, which controls stopping of the drive of the printing section 103.

In the case of replacing the label sheet 105 or 106 or removing jam occurred in the label printer 117, the upper housing 111 is upwardly swung to expose the storing section 104 and the printing section 103 to the outside of the label printer 117. In this condition, the line head 108 is upwardly swung and the ejection unit 126 is frontward slid, thereby separating the line head 108 and the ejection roller 116 from the platen roller 109. In this condition, the label sheet 105 or 106 in the storing section 104 can easily set into the printing section 103.

When at least one of the line head 108 and the ejection unit 126 is moved from the respective set position as mentioned above, the optical path 133 in the movable member detecting device 135 is cut off, and accordingly, the detection output of the light receiving element 132 is changed from the on-state to the off-state. This change is detected by the processing circuit 134, and the drive of the printing section 103 is controlled so as to be stopped by the processing circuit 134. Thus, the printing section 103 is kept inoperative under the condition that at least one of the line head 108 and the ejection unit 126 is out of the respective set positions, so that maintenance of the label printer 117 as mentioned above can be safely carried out.

After completing maintenance such as the replacement of the label sheet 105 or 106 or the removal of a jam, the line head 108 and the ejection unit 126 are returned to the respective set positions, and the upper housing 111 is then closed. Under this condition, the label issuing operation is restarted. At this time, even if the operator inadvertently fails to set at least one of the line head 108 and the ejection unit 126 and then closes the upper housing 111, the optical path 133 continues to be in the cut-off condition, and the processing circuit 134 prevents restarting power being supplied to the printing section 103 and controls the drive motor for rotationally driving the platen roller 109. Accordingly, malfunctioning of the label printer 117 can be prevented.

Consequently, movement of the line head 108 and the ejection unit 126 relative to the lower housing 110 can be detected by the single detecting device 135. Furthermore, the presence of the label issued from the label issue opening 300 can also be detected by the detecting device 135. Accordingly, the movable member detecting structure can be simplified so as to contribute to reduction in size and weight of the label printer 117 and an improvement in productivity.

According to the second preferred embodiment, the light emitting element 131 and the light receiving element 132 are located in the proximity to each other, and the reflecting surfaces 127 and 128 of the first and second prisms 129 and 130 are inclined at 45 degrees to form the vertical portion of the optical path 133 perpendicular to the issue direction of the label. Therefore, the length of the vertical portion of the optical path 133 between the reflecting surfaces 127 and 128 can be reduced. Further, since the sensor 301 is located on the side of the issue reference of the label, the total length of the optical path 133 can be reduced. Moreover, the first and second prisms 129 and 130 are elongated in the directions parallel to the horizontal portions of the optical path 133, respectively. Therefore, the distance between the light emitting element 131 and the first prism 129 and the distance between the light receiving element 132 and the second prism 130 can be reduced. As a result, scattering of the light in the overall optical path 133 from the light emitting element 131 to the light receiving element 132 can be suppressed to reduce loss of the light and effect efficient detection. Accordingly, it is unnecessary to increase a quantity of the light to be emitted from the light emitting element 131.

Further, since the reflecting surfaces 127 and 128 of the prisms 129 and 130 are inclined at 45 degrees, the location of the prisms 129 and 130 can be easily selected to make designing and the manufacturing easy to accomplish. Further, the first prism 129 is positioned by engaging the projections thereof with the positioning recesses of the eject unit 126, and the second prism 130 is similarly positioned by engaging the projections thereof with the positioning recesses of the line head 108. Therefore, positioning of the prisms 129 and 130 can be easily performed in mounting the prisms 129 and 130.

In the second preferred embodiment, the reflecting surfaces 127 and 128 are formed on the prisms 129 and 130, respectively, to make the light from the light emitting element 131 to the light receiving element 132 be partially transmitted through the prisms 129 and 130, thereby improving the optical characteristics. However, this construction is merely illustrative, and various modifications may be made. For example, a reflecting mirror may be provided on each movable member. Further, although the movable member detecting device 135 is applied to the label printer 117 in the second preferred embodiment, it may be applied to various kinds of equipment employing a plurality of movable members adapted to be relatively moved.

What is claimed is:

1. A label printer comprising:

a feeding section for feeding a label;

a printing section for printing a given image on the label fed by said feeding section, the printing section having a label issue opening from which the label is issued after the given image is printed thereon by said printing section;

a sensor having a light emitting element and a light receiving element;

a first prism located on one side of said label issue opening so as to lie on an optical axis of said light emitting element, said first prism having a reflecting surface for reflecting light emitted from said light emitting element; and a second prism located on the other side of said label issue opening so as to lie on an optical axis of said light receiving element, said second prism being completely disconnected from and spaced from said first prism so as to allow for passage of the label therebetween and having a reflecting surface for reflecting the light reflected on said reflecting surface of said first prism to said light receiving element.

2. The label printer as defined in claim 1, wherein said light emitting element and said light receiving element are located in proximity to each other aside one end of said label issue opening in a longitudinal direction thereof, and said reflecting surfaces of said first and second prisms are positioned so that an optical axis between said reflecting surfaces substantially perpendicularly intersects a surface of the label issued from said label issue opening.

3. The label printer as defined in claim 1, wherein said first prism is elongated in a direction of the optical axis of said light emitting element.

4. The label printer as defined in claim 1, wherein said second prism is elongated in a direction of the optical axis of said light receiving element.

5. The label printer as defined in claim 1, wherein said reflecting surfaces of said first and second prisms are inclined at 45 degrees with respect to the optical axes of said light emitting element and said light receiving element, respectively.

6. The label printer as defined in claim 1, further comprising first and second members for defining said label issue opening, said first and second prisms being mounted on said first and second members, respectively.

7. A label printer comprising:

a feeding section for feeding a label;

a printing section for printing a given image on the label fed by said feeding section;

the printing section having a label issue opening from which the label is issued after the given image is printed thereon by said printing section;

a sensor having a light emitting element and a light receiving element;

a first prism located on one side of said label issue opening so as to lie on an optical axis of said light emitting element, said first prism having a reflecting surface for reflecting light emitted from said light emitting element; and a second prism located on the other side of said label issue opening so as to lie on an optical axis of said light receiving element, said second prism having a reflecting surface for reflecting the light reflected on said reflecting surface of said first prism to said light receiving element wherein said light emitting element and said light receiving element are located in proximity to each other aside one end of said label issue opening in a longitudinal direction thereof, and said reflecting surfaces of said first and second prisms are positioned so that an optical axis between said reflecting surfaces substantially perpendicularly intersects a surface of the label issued from said label issue opening, wherein an issue reference of the label issued from said label issue opening is set at the one end of said label issue opening.

8. A label printer comprising:

a feeding section for feeding a label;

a printing section for printing a given image on the label fed by said feeding section, the printing section having a label issue opening from which the label is issued after the given image is printed thereon by said printing section;

a sensor having a light emitting element and a light receiving element;

a first prism located on one side of said label issue opening so as to lie on an optical axis of said light emitting element, said first prism having a reflecting surface for reflecting light emitted from said light emitting element; and a second prism located on the other side of said label issue opening so as to lie on an optical axis of said light receiving element, said second prism having a reflecting surface for reflecting the light reflected on said reflecting surface of said first prism to said light receiving element;

first and second members for defining said label issue opening, said first and second prisms being mounted on said first and second members, respectively, wherein said first and second members are provided with recesses, and said first and second prisms are provided with projections engaging with said recesses of said first and second members.

* * * * *